US005250254A

United States Patent [19]

Achikita et al.

[11] Patent Number: 5,250,254

[45] Date of Patent: Oct. 5, 1993

[54] COMPOUND AND PROCESS FOR AN INJECTION MOLDING

[75] Inventors: Masakazu Achikita, Kashiwa; Akihito Ohtsuka, Sakura, both of Japan

[73] Assignee: Sumitomo Metal Mining Co., Ltd., Japan

[21] Appl. No.: 814,193

[22] Filed: Dec. 20, 1991

Related U.S. Application Data

[60] Continuation of Ser. No. 731,000, Jul. 16, 1991, abandoned, which is a division of Ser. No. 555,089, Jul. 18, 1990.

[30] Foreign Application Priority Data

Jul. 20, 1989 [JP] Japan ..... 1-185933

[51] Int. Cl.[5] ..... B22F 1/00; B22F 3/16

[52] U.S. Cl. ..... 419/37; 419/36; 419/57

[58] Field of Search ..... 419/36, 37, 57

[56] References Cited

U.S. PATENT DOCUMENTS 4,721,599 1/1988 Nakamura ..... 419/23
5,006,164 4/1991 Kiyota ..... 75/255

*Primary Examiner*—Donald P. Walsh
*Assistant Examiner*—Daniel J. Jenkins
*Attorney, Agent, or Firm*—Wall and Roehrig

[57] ABSTRACT

A compound for producing sintered parts in an injection molding process and the molding process used to form the parts. The compound contains materials that allow the parts to be formed at lower temperatures and higher production rates when compared to more conventional processes.

5 Claims, No Drawings

COMPOUND AND PROCESS FOR AN INJECTION MOLDING

This is a continuation of copending application Ser. No. 07/731,000 filed on Jul. 16, 1991 now abandoned which is a division of application Ser. No. 555,089, filed Jul. 18, 1990 pending.

BACKGROUND OF THE INVENTION

This invention is related to a compound which is used in an injection molding process for producing precision machine components of metal or an alloy that are small in size and intricate in form.

According to a conventional injection molding process, sintered products manufactured by a powder metallurgy are produced by first pressing a metal or alloy powder and then sintering the part. However, it is difficult to manufacture such products which are three-dimensional, intricate in form, and have thin walls or knife-edge sections.

In order to overcome the aforementioned drawbacks associated with the conventional processes, a sintering process has been proposed in Japan Patent Laid-Open application Nos. 57-16,103, and 57-26,105, in which an injection-molding compound comprised of a metal or alloy powder and a binder are injection-molded in a metal die. The injection-molded material is heated to remove the binder component, and then is sintered to produce the final product.

Although the above improved process provides products having a higher sintering density because it utilizes metal or alloy powders having less than ten $\mu$m average particle diameter, there are still some problems associated therewith. Sufficiently high injection speed needed for high productivity cannot be achieved. Furthermore, the binder materials typically cannot be efficiently removed from the mold. When injection speeds are increased, the products become porous thereby adversely affecting the mechanical properties of the sintered product. Moreover, the binder-removal requires a relatively long time to complete and the removal temperatures are relatively high. This, in turn, causes the parts to crack, swell and/or deform during the sintering operation.

OBJECTS AND SUMMARY OF THE INVENTION

It is an object of the present invention to provide a compound for an injection-molding process in which metal or a metal alloy along with a binder material are used to mold precise parts, said process having improved binder removal properties and being capable of higher production rates.

In order to achieve these and other objects of this invention, studies of binder compositions and the weight ratio of their constituents and mixing ratio (in terms of volume ratio) of metal or metal alloy powders were carried out. It was found that the following composition and mixing ratios achieve the aforementioned objects of this invention. The green component used in the process contains one or more metals or metal alloy powders for sintering and a binder component that includes 10–80% by weight of a low density polyethylene; 10–80% by weight of a paraffin group wax; 5–35% by weight of an ester of boric acid; and 0.1–5% by weight of polyoxyethylenealkylester group or polyoxyethylenealkylether group. The volume ratio of the sintering-powder consisted of 30–70% of one or more than one type of metal or metal allow powder and the 70–30% of a binder.

The sintering powder which can be used in this invention can be one or more types of powder consisting of pure iron, stainless steel, carbonyl iron, or pure cobalt. The low density polyethylene can be any type of commercially available material. Paraffin-group wax can be simply pure paraffin wax. The ester of boric acid can be selected from one or more of the triglycoldiborate-group; trialkylborate-group; glycerolborate-group; or alkinediborate with the trialkylborate group being preferred. More specifically, the triglycoldiborate-group can be 1,6-bis (5-ethyl-4-propyl-1,3,2-diboxabora-2-cyclohexyloxy) hexane, or 1,4-bis (5-ethyl-4-propyl-1,3,2-dioxabora-2-cyclohexyloxy) butane. As for the trialkylborate-group, any one from trimethylborate, triethylborate, tributhylborate, or triamyborate can be chosen. Any one from glycerolboratestearate, or polyoxyethyleneglycerolboratepalmitate can be selected as the glycerolborate-group. As for the alkinediborate-group, a methyldiborate or ethyldiborate can be chosen.

The borate-ester can be used as one or a mixture of these materials. When it is mixed with other components, it will be preferable to dissolve it with solvents such as benzene, toluene, or xylene to prepare a solution of 60–80% by weight. This will enhance the mixing efficiency of metal powder with organic binders. Hence, the binder component contains a certain amount of solvent as a constituent of said binder. For both polyoxyethylenealkylester-group and polyoxyethylenealkylether-group, commercial available type of surface activators having a formula such as $RCOO(C_2H_4O)_nH$ and $RO(C_2H_4)_nH$, respectively can be utilized.

The equipment and facility which are usually employed for the molding of plastics can also be used to injection mold powders prepared according to the present invention, under the following operation conditions; the molding temperature is 80°–200° C., the injection speed is 150–250 mm/second, and the injection pressure is 500–2,000kg/cm$^2$. Although the above injection speed is more than two times faster than the conventional injection speed, it was found that the mechanical properties of final products were not adversely affected.

When the precise products having the above composition is heated and degassed in the equipment, an inert or reduction gas for powders which is easily oxidized can be used; while air or inert gas can be used for sintering the mixed powders which cannot be as easily oxidized during the sintering process. In any case, the binder-removal can be achieved at temperatures of between 250°–300° C. using a heating rate of 12°–30° C./hour. When using the conventional composition of mixed compound, it is required to treat the compound at relatively higher temperatures such as 400°–550° C. with a slower heating rate of 1°–10° C./hour. Therefore, in the practice of the present invention, high temperature heat treatment and slow heating rates are unnecessary, resulting in a great improvement in the efficiency of the binder-removal process.

Reasons for limiting the aforementioned mixing composition, in terms of the noted volume and weight ratios, are based on several factors of concern. The volume ratio of metal or alloy powder as a sintering-powder is, as mentioned before, 30–70%. This is due to the fact that (1) if the volume ratio is less than 30%, the fluidability of the compound will deteriorate during the injection process to a point where the injection-molding operation cannot be successfully completed, and (2) the compacting density of the sintering powder into the injection-molded products must be low, resulting in a final sintered product having a relatively low density. On the other hand, if the volume ratio of the sintering powder exceeds 70%, the strength of the injection-molded products is lower, cracks will be formed in the part due to surface-shrinkage.

If the low density polyethylene is less than 10% by weight of the binder, both the strength and shape-stability of the injection-molded products are reduced and cracks will form on the surface of the molded products. If the low density polyethylene is more than 80% by weight of the binder, the time needed for the complete removal of the binder is unreasonably long.

Moreover, one reason for using 10–80% by weight of the paraffin-group wax stems from the fact that if the paraffin-group wax is contained with less than 10% by weight, the injection-moldability of the material becomes poor, and both the temperature and the time for complete removal of the binder will be extended. If it exceeds more than 80% by weight, the molded products will exhibit reduced mechanical strength and poor shape-stability, and the molded part becomes difficult to handle.

The reason for defining the amount of borate-ester as being 5–35% by weight is to 1) improve the mixing efficiency of the sintering powder, 2) stabilize the binder-removal process, and 3) enhance the density and the shape-stability of the final sintered products. Therefore, if the borate-ester is less than 5% by weight, the final product will possess porosity defects due to poor mixing. At the same time, if it exceeds 35% by weight, the strength of the products is weakened.

Finally, as also mentioned above, the polyoxyethylenealkylester-group or polyoxyethylenealkylether-group is defined as being 0.1–5% by weight. This is based on the fact that if it is less than 0.1% by weight, the injection speed must be relatively high, thus producing porosity defects in the product. If it exceeds 5% by weight, the strength of the sintered products is weakened.

It is also demonstrated that adding stearic acid with less than 20% by weight to the present compound, the removability of the molded products from the metal die is improved without effecting the final product.

DETAILED DESCRIPTION OF A PREFERRED EMBODIMENT

Sintered parts having sharp edges and thin wall configurations were injection-molded using various binders with atomized stainless steel powder (17Cr-4Ni-Fe, SUS 630), having a 15 μm diameter average particle size. Details of these compositions are set forth as Examples 1–6 in Table 1 below. The atomized stainless steel powder was added to variously prepared binders, mixed and injection-molded into a gear-like shape. Characteristics of the injection-molded part are listed in Table 2 below.

The weight changes of the product before and after the heating operation were measured in a nitrogen gas atmosphere. The surfaces of the products were examined and tested to determine when the binder residue was less than 1% by weight of the final product's total weight after binder-removal. The results of the test are also presented in Table 2 as a function of both heating temperature and time.

The molded products, whose surface appearances were evaluated as "good" in Table 2, were then sintered at 1,250° C. for 1 (one) hour. It was observed that this procedure provided excellent sintered parts. Plate-shape test samples were prepared according to standards issued by "Japan Society of Powder and Powder Metallurgy" in order to test the strength of the sintered products. The strength tests were repeated five times. The average tensile strength and elongation values for the parts are listed in Table 3 below.

From the noted examples 1 through 6, it can be seen that all of the compounds are suitable for use in a high speed injection-molding, and that binder-removal can be completed at a relatively low temperature of about 250° C. over shortened periods of time lasting about 16–26 hours. The appearance of the molded parts were also evaluated as being excellent.

In another embodiment of the invention, powders listed in Table 4 below were added to a binder in 60:40 volume ratio. The binder consisted of a low density polyethylene (fluidability 200) 20% by weight, paraffin-group wax 60% by weight,. borate-ester 18% by weight and polyoxyethylenealkylester (molecular weight is about 900) 2% by weight. The injection-moldability of this example showed similarly good results as the previously noted examples.

After the binder-removal process was completed at 250° C. for 16 hours, the appearances of the products were evaluated excellent as in the previous examples. Furthermore, the molded components were sintered under the conditions listed in Table 4, followed by testing of the mechanical strength. The results are listed in Table 4.

In order to compare the results listed in Table 4, a metal powder without any binding composition was press-sintered using conventional procedures known in the prior art and similar strength tests were performed. The results are listed in Table 5 below. From a comparison of the results shown in Tables 4 and 5, it can be clearly seen that the presently invented compound exhibits far superior characteristics when compared to similar products made by the more conventional prior art process.

Another example using polyoxyethylenealkylether (molecular weight is approximately 900) instead of polyoxyethylenealkylester showed similarly excellent results as exhibited in Tables 1 through 4.

In accordance with the teachings of this invention, excellent injection-molded parts can be produced using a metal or alloy sintering powder in a high speed injection process. The binder-removal procedure is substantially shortened without adversely effecting any of the final sintered product properties. Accordingly, manufacturing powder-sintered products through this injection-molding process can be achieved economically to produce very intricately shaped parts having thin walls and sharp edges.

TABLE 1

| binder composition (by weight %) | | |
|---|---|---|
| low density polyethylene fluidability | polyoxyethylene-alkylester | low molecule |

TABLE 1-continued

| | 250 | 200 | 50 | paraffin-group wax | borate-ester | (molecule: ca. 900) | stearic acid | polypropylene |
|---|---|---|---|---|---|---|---|---|
| example 1 | 20 | — | — | 60 | 18 | 2 | — | — |
| example 2 | 40 | — | — | 50 | 8 | 2 | — | — |
| example 3 | 20 | — | — | 60 | 13 | 2 | 5 | — |
| example 4 | — | 75 | — | 15 | 8 | 2 | — | — |
| example 5 | — | 50 | — | 16 | 30 | 4 | — | — |
| example 6 | 40 | | — | 50 | 9.8 | 0.2 | — | — |
| comparison 1 | — | 20 | — | 60 | 19 | 1 | — | — |
| comparison 2 | — | 20 | — | 60 | 19 | 1 | — | — |
| comparison 3 | — | 11 | — | 82 | 6 | 1 | — | — |
| comparison 4 | — | 75 | — | 9 | 15 | 1 | — | — |
| comparison 5 | — | 82 | — | 11 | 6 | 1 | — | — |
| comparison 6 | — | 9 | — | 75 | 15 | 1 | — | — |
| comparison 7 | — | 30 | — | 30 | 39 | 1 | — | — |
| comparison 8 | — | 27 | — | 70 | 2 | 1 | — | — |
| comparison 9 | — | 20 | — | 55 | 16 | 9 | — | — |
| comparison 10 | 40 | — | — | 40 | 20 | — | — | — |
| conventional 1 | — | — | — | — | — | — | — | 60 |
| conventional 2 | — | — | 5 | 90 | — | — | — | — |
| conventional 3 | — | 20 | — | — | — | — | 10 | — |

| | binder composition (by weight %) | | | | |
|---|---|---|---|---|---|
| | partially saponified wax | dibutylphthalate | ethyleneacrylate | mineral-system oil solvent | binder mixing ratio (volume %) |
| example 1 | — | — | — | — | 34 |
| example 2 | — | — | — | — | 39 |
| example 3 | — | — | — | — | 32 |
| example 4 | — | — | — | — | 50 |
| example 5 | — | — | — | — | 32 |
| example 6 | — | — | — | — | 39 |
| comparison 1 | — | — | — | — | 75 |
| comparison 2 | — | — | — | — | 27 |
| comparison 3 | — | — | — | — | 34 |
| comparison 4 | — | — | — | — | 40 |
| comparison 5 | — | — | — | — | 34 |
| comparison 6 | — | — | — | — | 44 |
| comparison 7 | — | — | — | — | 40 |
| comparison 8 | — | — | — | — | 36 |
| comparison 9 | — | — | — | — | 34 |
| comparison 10 | — | — | — | — | 40 |
| conventional 1 | 15 | 25 | — | — | 44 |
| conventional 2 | — | — | 3 | 2 | 38 |
| conventional 3 | 70 | — | — | — | 34 |

TABLE 2

| | injection-moldability | binder-removalability heating temp. (°C.) | heating time (hours) | appearance |
|---|---|---|---|---|
| example 1 | good | 250 | 26 | good |
| example 2 | good | 250 | 16 | good |
| example 3 | good | 250 | 16 | good |
| example 4 | good | 250 | 18 | good |
| example 5 | good | 250 | 16 | good |
| example 6 | good | 250 | 16 | good |
| comparison 1 | good | 250 | 18 | partially deformed |
| comparison 2 | no molding | — | — | — |
| comparison 3 | low strength of molded product | 250 | 16 | deformation |
| comparison 4 | high injection pressure | 250 | 80 | good |
| comparison 5 | no molding | — | — | — |
| comparison 6 | good | 500 | 80 | deformation |
| comparison 7 | low strength and fracture of molded product | — | — | — |
| comparison 8 | binder separation | 250 | 18 | porous |
| comparison 9 | low strength and fracture of | — | — | — |

TABLE 2-continued

| | injection-moldability | binder-removalability heating temp. (°C.) | heating time (hours) | appearance |
|---|---|---|---|---|
| comparison 10 | molded product binder separation | 280 | 24 | porous |
| conventional 1 | high injection pressure | 500 | 70 | good |
| conventional 2 | low strength of molded product | 300 | 24 | partially deformed |
| conventional 3 | large shrinkage | 500 | 70 | crack |

TABLE 3

| test sample | mechanical properties after sintering tensile strength ($kg/mm^2$) | elongation (%) |
|---|---|---|
| example 1 | 121 | 13.6 |
| example 2 | 122 | 13.0 |
| example 3 | 123 | 12.7 |
| comparison 4 | 113 | 13.7 |
| conventional 1 | 115 | 13.2 |

TABLE 4

| sintering powder | average particle size | process | sintering condition | strength of sintered product: tensile strength ($kg/mm^2$) | strength of sintered product: elongation (%) |
|---|---|---|---|---|---|
| stainless steel (SUS 316L) | 15 μm | gas-atomized powder | 1350° C. × 2 hr | 96.3 | 68.7 |
| pure iron | 5 μm | carbonyl powder | 1350° C. × 2 hr | 24.8 | 15.9 |
| Fe—0.5P | 5 μm<br>−300 mesh | carbonyl iron powder<br>27P—Fe crushed powder | 1300° C. × 1 hr | 36.7 | 34.9 |
| 50Co—Fe | 5 μm<br>4.5 μm | carbonyl iron powder<br>reduced Co powder | 1350° C. × 2 hr | 136.1 | 3.1 |
| Fe—2Ni | 5 μm<br>5 μm | carbonyl iron powder<br>carbonyl nickel powder | 1300° C. × 1 hr | 43.5 | 33.5 |
| pure Co | 4.5 μm | reduced Co powder | 1350° C. × 2 hr | 46.2 | 28.1 |

TABLE 5

| sintering powder | average particle size | process | sintering condition | strength of sintered product: tensile strength ($kg/mm^2$) | strength of sintered product: elongation (%) |
|---|---|---|---|---|---|
| stainless steel (SUS 316L) | 15 μm | gas-atomized powder | 1350° C. × 2 hr | 63.1 | 58.2 |
| pure iron | 5 μm | carbonyl powder | 1350° C. × 2 hr | 16.2 | 14.0 |
| Fe—0.5P | 5 μm<br>−300 mesh | carbonyl iron powder<br>27P—Fe crushed powder | 1300° C. × 1 hr | 35.0 | 30.1 |
| 50Co—Fe | 5 μm<br>4.5 μm | carbonyl iron powder<br>reduced Co powder | 1350° C. × 2 hr | 124.5 | 2.0 |
| Fe—2Ni | 5 μm<br>5 μm | carbonyl iron powder<br>carbonyl nickel powder | 1300° C. × 1 hr | 41.2 | 29.4 |
| pure Co | 4.5 μm | reduced Co powder | 1350° C. × 2 hr | 42.1 | 19.0 |

While this invention has been explained with reference to the structure disclosed herein, it is not confined to the details as set forth and this application is intended to cover any modifications and changes as may come within the scope of the following claims.

What is claimed is:

1. A process of forming a sintered product including the step of placing a compound formed of a binder and at least one metal powder or metal alloy powder in an injection-molded cavity, said binder includes a low density polyethylene, a paraffin way, a borate ester and a polyoxyethylenealkylester or a polyoxyethylene alkylester, injecting the compound at a speed between 150 and 250 mm/sec and heating the compound in the mold to a temperature of between 150° and 250° C. to form a molded part, removing the part from the mold and heating the part at a temperature of between 250° C. to 300° C. at a heating rate of 12°-30° C. per hour to remove the binder.

2. The process of claim 1 wherein the binder is removed in air.

3. The process of claim 1 wherein the binder is removed in an inert atmosphere.

4. The process of claim 1 wherein the low density polyethylene comprises 10–80% by weight of the binder, the paraffin wax comprises between 10–80% by weight of the binder the borate ester comprises 5–35% by weight of the binder and either the polyoxyethylene alkylester group or a polyoxyethylenealkylether group comprising between 0.1–5% by weight of the binder.

5. The process of claim 4 including the further step of maintaining the volumetric content of the binder in the molding compound between 30 and 70%.

* * * * *

UNITED STATES PATENT AND TRADEMARK OFFICE

CERTIFICATE OF CORRECTION

PATENT NO. : 5,250,254

DATED : October 5, 1993

INVENTOR(S) : MASAKAZU ACHIKITA

It is certified that error appears in the above—identified patent and that said Letters Patent is hereby corrected as shown below:

Col. 7, line 42, please delete "way" and insert --wax--;

line 46, please delete "150" and insert --80--;

line 46, please delete "250" and insert --200--.

Signed and Sealed this

Twelfth Day of April, 1994

*Attest:*

Bruce Lehman

BRUCE LEHMAN

*Attesting Officer*

*Commissioner of Patents and Trademarks*